US012729904B2

(12) United States Patent
Foster

(10) Patent No.: US 12,729,904 B2
(45) Date of Patent: Sep. 8, 2026

(54) REFRIGERATOR APPLIANCE WITH POWERED PITCHER

(71) Applicant: Haier US Appliance Solutions, Inc., Wilmington, DE (US)

(72) Inventor: Ronald Gary Foster, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 67 days.

(21) Appl. No.: 18/820,916

(22) Filed: Aug. 30, 2024

(65) Prior Publication Data

US 2026/0063357 A1 Mar. 5, 2026

(51) Int. Cl.
*F25D 25/00* (2006.01)

(52) U.S. Cl.
CPC ..... *F25D 25/005* (2013.01); *F25D 2331/81* (2013.01); *F25D 2400/40* (2013.01)

(58) Field of Classification Search
CPC . F25D 25/005; F25D 2331/81; F25D 2400/40
See application file for complete search history.

(56) References Cited

U.S. PATENT DOCUMENTS 3,178,061 A * 4/1965 Giacalone ..... F25D 23/04 222/146.6
3,506,325 A * 4/1970 Horvay ..... F25D 25/02 312/223.5
6,042,244 A * 3/2000 Witkoski ..... A47F 11/10 362/394
6,227,004 B1 * 5/2001 Gerstein ..... A47G 19/2288 62/421
7,513,278 B2 * 4/2009 Hengsperger ..... C02F 1/003 141/85
10,889,484 B2 1/2021 Subramanya et al.
10,912,409 B2 2/2021 Wantland et al.
11,319,959 B2 * 5/2022 Castle ..... F04D 29/582
11,871,860 B2 1/2024 Alexander et al.
2004/0149643 A1 * 8/2004 Vandenbelt ..... C02F 9/20 210/748.13
2016/0134064 A1 * 5/2016 Lee ..... F25D 25/025 439/529
2017/0191743 A1 * 7/2017 Lee ..... F25D 27/00
2017/0280737 A1 * 10/2017 Liao ..... C02F 1/725
2018/0195795 A1 * 7/2018 Simone ..... A47J 41/0044
2021/0310729 A1 * 10/2021 Alexander ..... F25D 31/006
2021/0396459 A1 * 12/2021 Kwon ..... F25D 23/04

(Continued)

FOREIGN PATENT DOCUMENTS

CN 219199692 U * 6/2023
CN 118031497 A * 5/2024 ..... F25D 23/126

(Continued)

*Primary Examiner* — Andrew Roersma
(74) *Attorney, Agent, or Firm* — Dority & Manning, P.A.

(57) ABSTRACT

A pitcher for a refrigerator appliance is provided. The refrigerator appliance includes a cabinet defining a fresh food chamber. The pitcher includes at least one pitcher wall and an internal volume defined within the at least one pitcher wall. The pitcher is configured to be received in a cavity defined in the fresh food chamber. The pitcher also includes a detachable electrical connector configured to connect between the pitcher and the cavity.

15 Claims, 6 Drawing Sheets

(56) References Cited

U.S. PATENT DOCUMENTS

| | | | | |
|---|---|---|---|---|
| 2023/0227332 | A1* | 7/2023 | Ring | C02F 1/325<br>210/85 |
| 2023/0324108 | A1* | 10/2023 | Kim | F25D 23/12 |
| 2024/0081578 | A1 | 3/2024 | Agam et al. | |
| 2024/0255213 | A1* | 8/2024 | Kim | F25D 23/04 |

FOREIGN PATENT DOCUMENTS

| | | | | |
|---|---|---|---|---|
| KR | 20220145711 | A | 10/2022 | |
| WO | WO-2006065723 | A2 * | 6/2006 | C02F 1/325 |
| WO | WO-2007078294 | A1 * | 7/2007 | C02F 9/20 |
| WO | WO-2025178238 | A1 * | 8/2025 | A47B 96/02 |

* cited by examiner

REFRIGERATOR APPLIANCE WITH POWERED PITCHER

FIELD OF THE INVENTION

The present subject matter relates generally to refrigerator appliances, and more particularly to pitcher systems for refrigerator appliances.

BACKGROUND OF THE INVENTION

Some refrigerator appliances include a housing and/or a shelf with a pitcher configured to be received in the housing and/or on the shelf. Although the water in the pitcher is generally chilled due to being stored within the refrigerator appliance, some users may desire additional features beyond simply storing and chilling contents, e.g., water, in the pitcher. For example, it may be desired to provide the pitcher with features for mixing beverages, e.g., a stirrer or other agitator, a light for illuminating an interior of the pitcher, among other possible additional features. Thus, such features may require providing electrical power to the pitcher. However, the pitcher may be removed from the refrigerator appliance and used to fill vessels, etc., as is generally understood. Accordingly, it is difficult to provide reliable, consistent, and repeatable electrical power supply to such pitchers.

Accordingly, a system that addresses one or more of the challenges noted above would be desirable, such as a refrigerator appliance and/or a pitcher receivable therein with a detachable electrical connection between the pitcher and the remainder of the refrigerator appliance.

BRIEF DESCRIPTION OF THE INVENTION

Aspects and advantages of the invention will be set forth in part in the following description, may be apparent from the description, or may be learned through practice of the invention.

In one exemplary aspect, a refrigerator appliance is provided. The refrigerator appliance includes a cabinet. The cabinet defines a fresh food chamber. The refrigerator appliance also includes a pitcher. The pitcher includes at least one pitcher wall and an internal volume defined within the at least one pitcher wall. A cavity is provided in the fresh food chamber. The cavity is defined by at least one cavity wall. The cavity is configured to receive the pitcher. The refrigerator appliance also includes a detachable electrical connection between the pitcher and the cavity.

In another example aspect, a pitcher for a refrigerator appliance is provided. The refrigerator appliance includes a cabinet defining a fresh food chamber. The pitcher includes at least one pitcher wall and an internal volume defined within the at least one pitcher wall. The pitcher is configured to be received in a cavity defined in the fresh food chamber. The pitcher also includes a detachable electrical connector configured to connect between the pitcher and the cavity.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
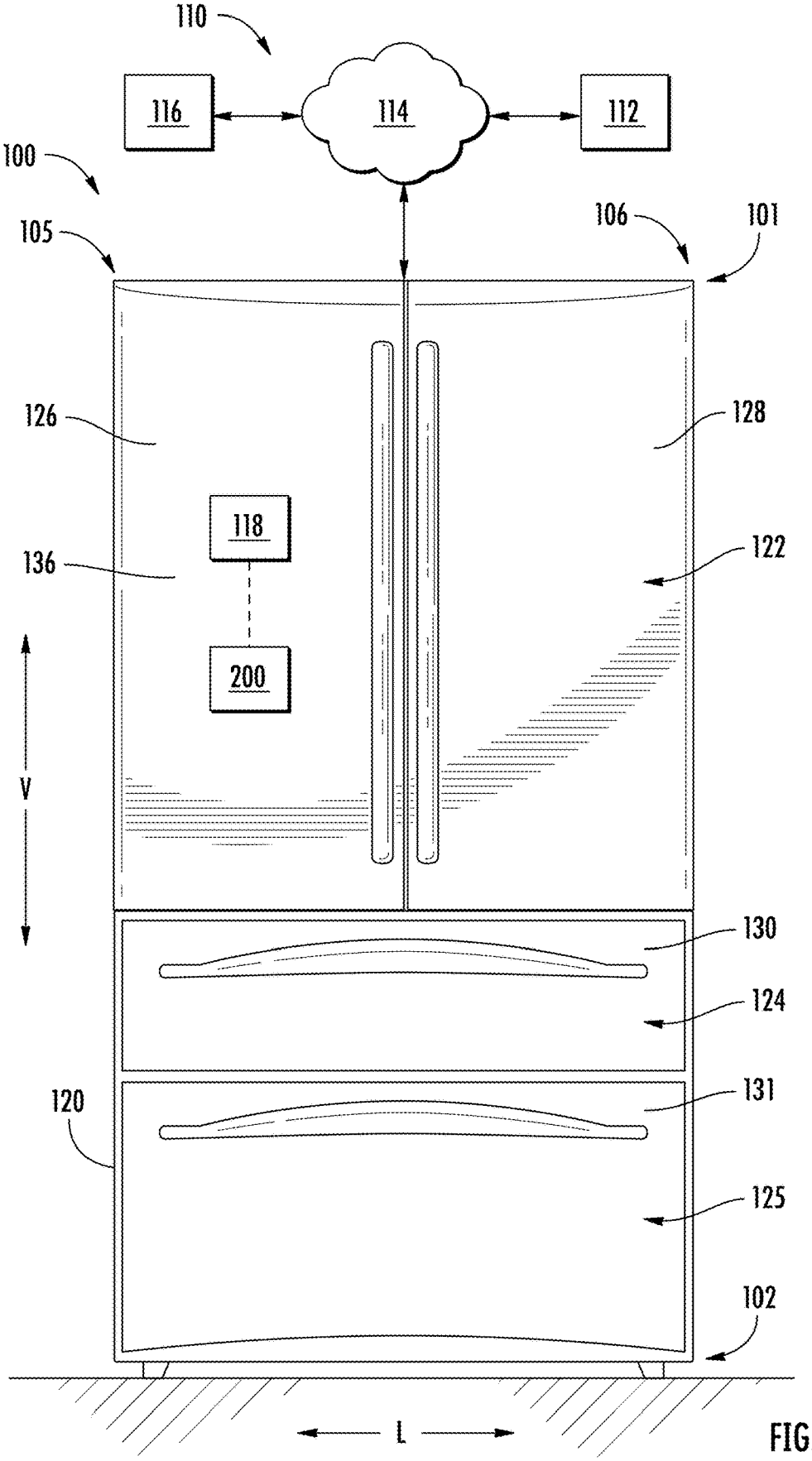
FIG. 1 provides a front view of a refrigerator appliance according to one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent (10%) margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Turning to the figures, FIG. 1 provides a front view of an exemplary refrigerator appliance 100 according to one or more exemplary embodiments of the present disclosure. Refrigerator appliance 100 extends between a top 101 and a bottom 102 along a vertical direction V, between a left side 105 and a right side 106 along a lateral direction L, and extends between a front and a back along a transverse direction T (not shown), which is a direction orthogonal to the vertical direction V and the lateral direction L. Vertical direction V, lateral direction L, and transverse direction T are mutually perpendicular and form an orthogonal direction system.

Figure 2:
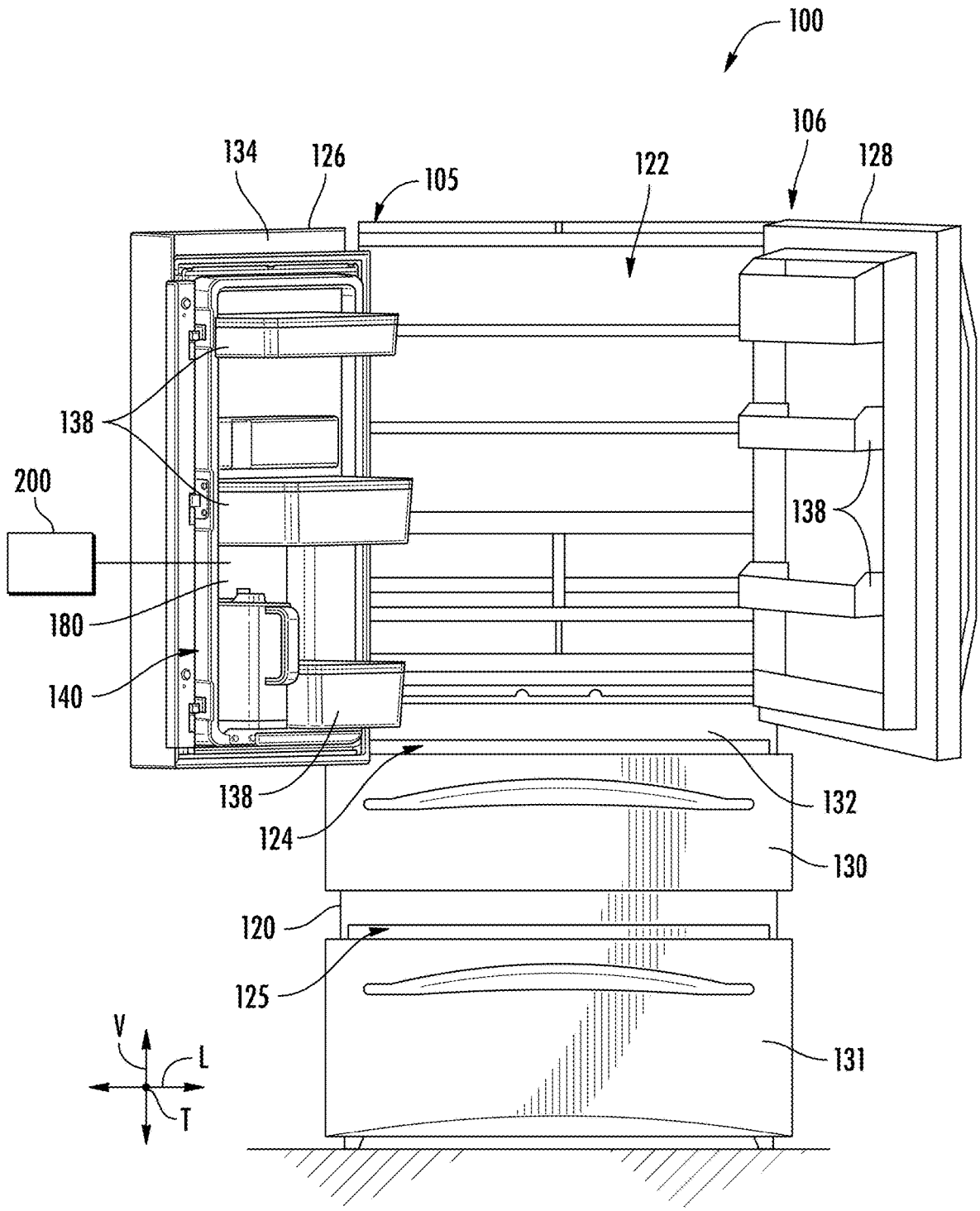
FIG. 2 provides a front view of the refrigerator appliance of FIG. 1 with refrigerator doors shown in an open configuration.

Refrigerator appliance 100 includes a housing or cabinet 120 defining one or more chilled chambers, which may include various combinations of one or more of each of fresh food chamber(s) and/or freezer chamber(s). For example, the illustrated refrigerator appliance 100 depicted in FIGS. 1 and 2 includes a fresh food chamber 122, a first freezer chamber 124, and a second freezer chamber 125. The freezer chambers 124 and 125 may both be arranged below fresh food chamber 122 along the vertical direction V, e.g., as illustrated in FIGS. 1 and 2. In additional embodiments, the middle chamber may be a flexible chamber in place of first freezer chamber 124 and may be selectively operable at various temperatures for storing any desired food items, such as produce, wine, etc. As illustrated, fresh food chamber 122 is bounded by vertical walls at the left side 105 and at the right side 106, such walls spaced apart in the lateral direction, a horizontal wall at the top 101 and at the bottom by a lower wall 132. In this configuration, refrigerator appliance 100 may generally be referred to as a bottom mount, or bottom freezer, refrigerator. Cabinet 120 also defines a mechanical compartment (not shown) for receipt of a sealed cooling system (not shown).

Left and right refrigerator doors 126, 128, respectively, are rotatably hinged to an edge of cabinet 120 at left 105 and right 106 sides, respectively, for accessing fresh food chamber 122 (FIG. 2) or sealing fresh food chamber 122 as illustrated in FIG. 1. For example, upper and lower hinges may couple each door 126, 128 to cabinet 120. When left and right doors 126, 128 are configured as illustrated in FIG. 1, the door arrangement is sometimes referred to as a "French door" configuration. Freezer doors, such as a first freezer door 130 and a second freezer door 131, may be arranged below refrigerator doors 126, 128 for accessing one or more freezer chambers, such as first and second freezer chambers 124, 125, respectively. In the exemplary embodiment shown in FIG. 1, freezer doors 130, 131 are coupled to freezer drawers (not shown) slidably mounted within first and second freezer chambers 124, 125. Such drawers are thus generally "pull-out" drawers in that they can be manually moved into and out of freezer chambers 124, 125 on suitable slide mechanisms. Each door 126, 128, 130, 131 can include a handle for accessing one of the chambers 122, 124, 125 of refrigerator appliance 100.

Referring still to FIG. 1, a schematic diagram of an external communication system 110 will be described according to an exemplary embodiment of the present subject matter. In general, external communication system 110 is configured for permitting interaction, data transfer, and other communications between appliance 100 and one or more external devices. For example, this communication may be used to provide and receive operating parameters, user instructions or notifications, performance characteristics, user preferences, or any other suitable information for improved performance of appliance 100. In addition, it should be appreciated that external communication system 110 may be used to transfer data or other information to improve performance of one or more external devices or appliances and/or improve user interaction with such devices.

For example, external communication system 110 permits controller 200 of appliance 100 to communicate with a separate device external to appliance 100, referred to generally herein as an external device 112. As described in more detail below, these communications may be facilitated using a wired or wireless connection, such as via a network 114. In general, external device 112 may be any suitable device separate from appliance 100 that is configured to receive communications, information, or data from the controller 200 regarding the operation of refrigerator appliance 100, or provide commands from a user to the controller 200 of the refrigerator appliance 100. In this regard, external device 112 may be, for example, a personal phone, a smartphone, a tablet computer, a laptop or personal computer, a wearable device, a smart home system, or another mobile or remote device. Controller 200 is in operative communication with external device 112 through network 114 of external communication system 110.

In addition, a remote server 116 may be in communication with appliance 100 and/or external device 112 through network 114. In this regard, for example, remote server 116 may be a cloud-based server 116, and is thus located at a distant location, such as in a separate state, country, etc., from the appliance 100. In additional embodiments, the remote server 116 may be in the fog or the edge instead of the cloud. According to an exemplary embodiment, external device 112 may communicate with a remote server 116 over network 114, such as the Internet, to transmit/receive data or information, provide user inputs, receive user notifications or instructions, interact with or control appliance 100, etc. In addition, external device 112 and remote server 116 may communicate with appliance 100 to communicate similar information.

In general, communication between appliance 100, external device 112, remote server 116, and/or other user devices or appliances may be carried using any type of wired or wireless connection and using any suitable type of communication network, non-limiting examples of which are provided below. For example, external device 112 may be in direct or indirect communication with appliance 100 through any suitable wired or wireless communication connections or interfaces, such as network 114. For example, network 114 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 110 is described herein according to an exemplary embodiment of the present subject matter. However, it should be appreciated that the exemplary functions and configurations of external communication system 110 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

FIG. 2 provides a front perspective view of refrigerator appliance 100 showing refrigerator doors 126, 128 in an open position to reveal the interior of fresh food chamber 122. Additionally, freezer doors 130, 131 are shown in partially open positions to reveal a portion of the interior of freezer chambers 124, 125, respectively.

Left door 126 of refrigerator appliance 100 includes an inner surface 134 and an outer surface 136. Inner surface 134 generally defines a portion of the interior of fresh food chamber 122 when door 126 is in a closed position as shown in FIG. 1. Outer surface 136 is generally opposite inner surface 134 and defines a portion of the exterior of refrigerator appliance 100 when door 126 is in the closed position.

The same construction may result in a similarly formed right door 128 as left door 126, with inner surface 134 and outer surface 136. Moreover, it will further be appreciated that freezer doors 130, 131 can likewise include inner and outer surfaces.

Doors 126, 128 may include storage bins or shelves 138 movably or fixedly attached to the inner surface 134 of the doors 126, 128. In the embodiment illustrated in FIG. 2, left door 126 includes a pitcher system 140, which may in some optional embodiments be an autofill pitcher system which includes features for dispensing ice and/or liquid water to the pitcher. The autofill pitcher system 140 is illustrated on the left door 126 for convenience. In other embodiments, the autofill pitcher system 140 may be in a different position on the left door 126, or on the right door 128, or elsewhere within the fresh food chamber 122. The autofill pitcher system 140 comprises a removable pitcher 142, a dispenser 180, and controller 200 (FIGS. 1 and 2). In additional embodiments, a pitcher system according to the present disclosure may omit the dispenser 180.

Figure 3:
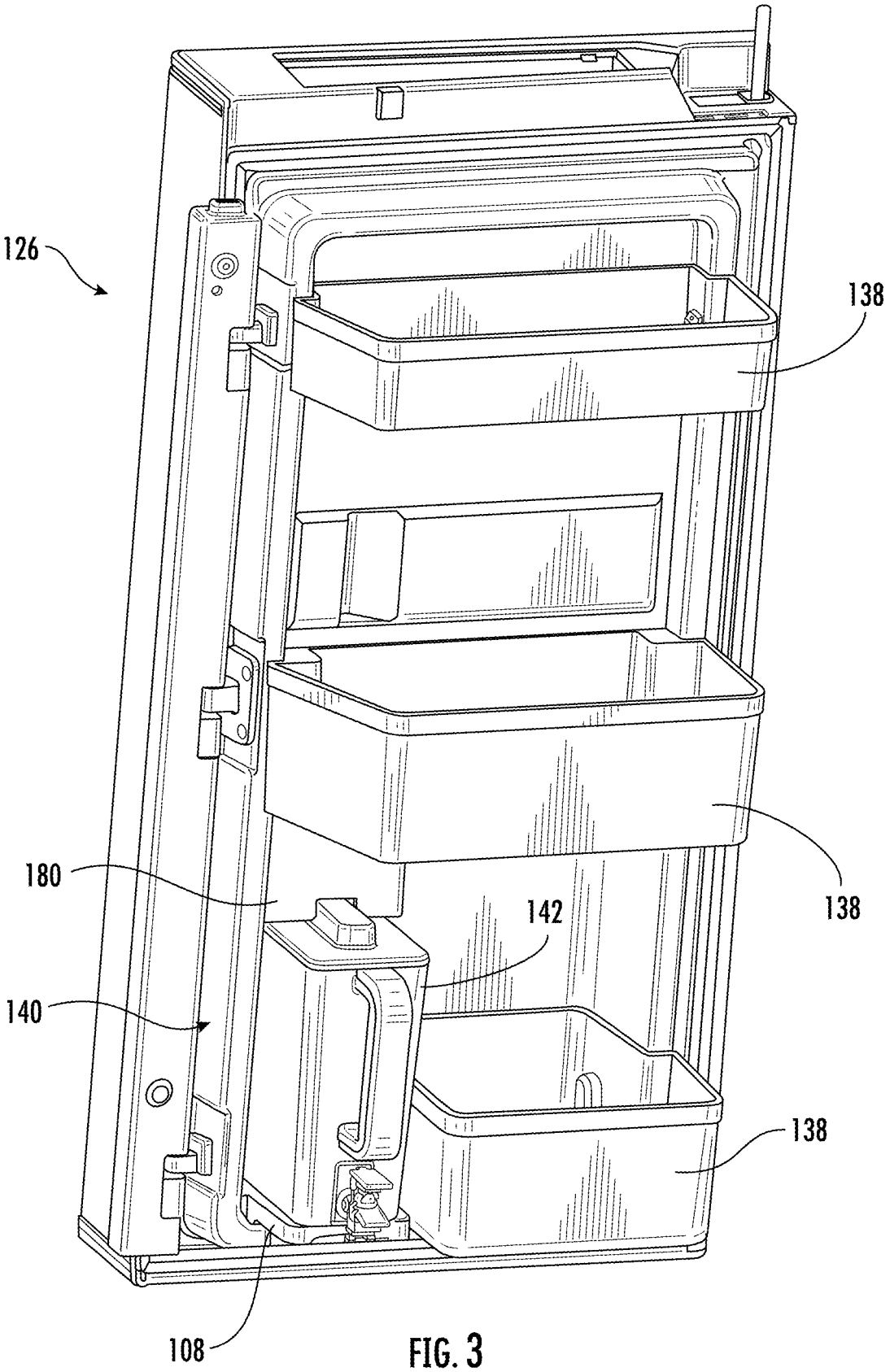
FIG. 3 provides a perspective view of an exemplary door of a refrigerator appliance according to one or more exemplary embodiments of the present disclosure.
Figure 4:
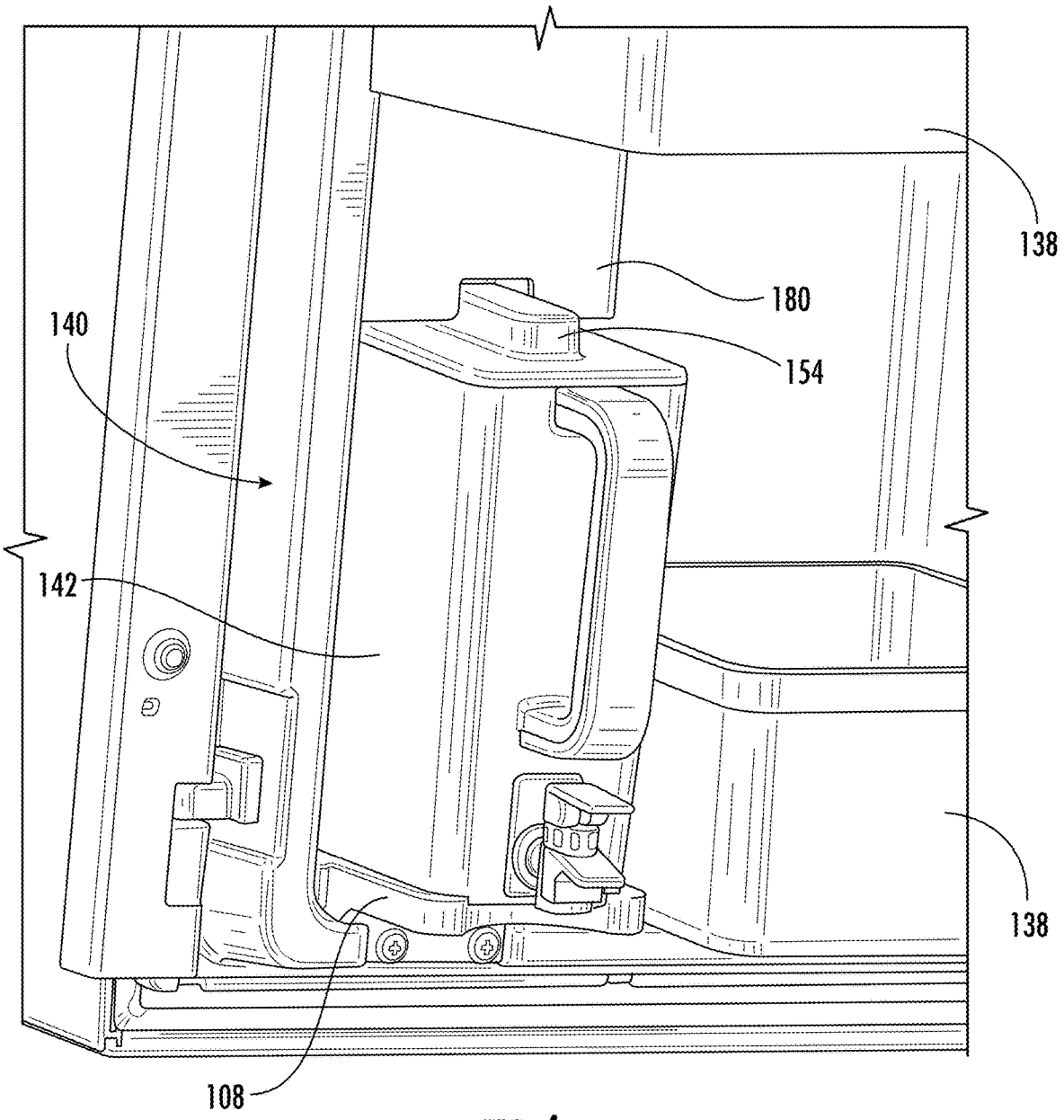
FIG. 4 provides an enlarged perspective view of a portion of the door of FIG. 3.
Figure 6:
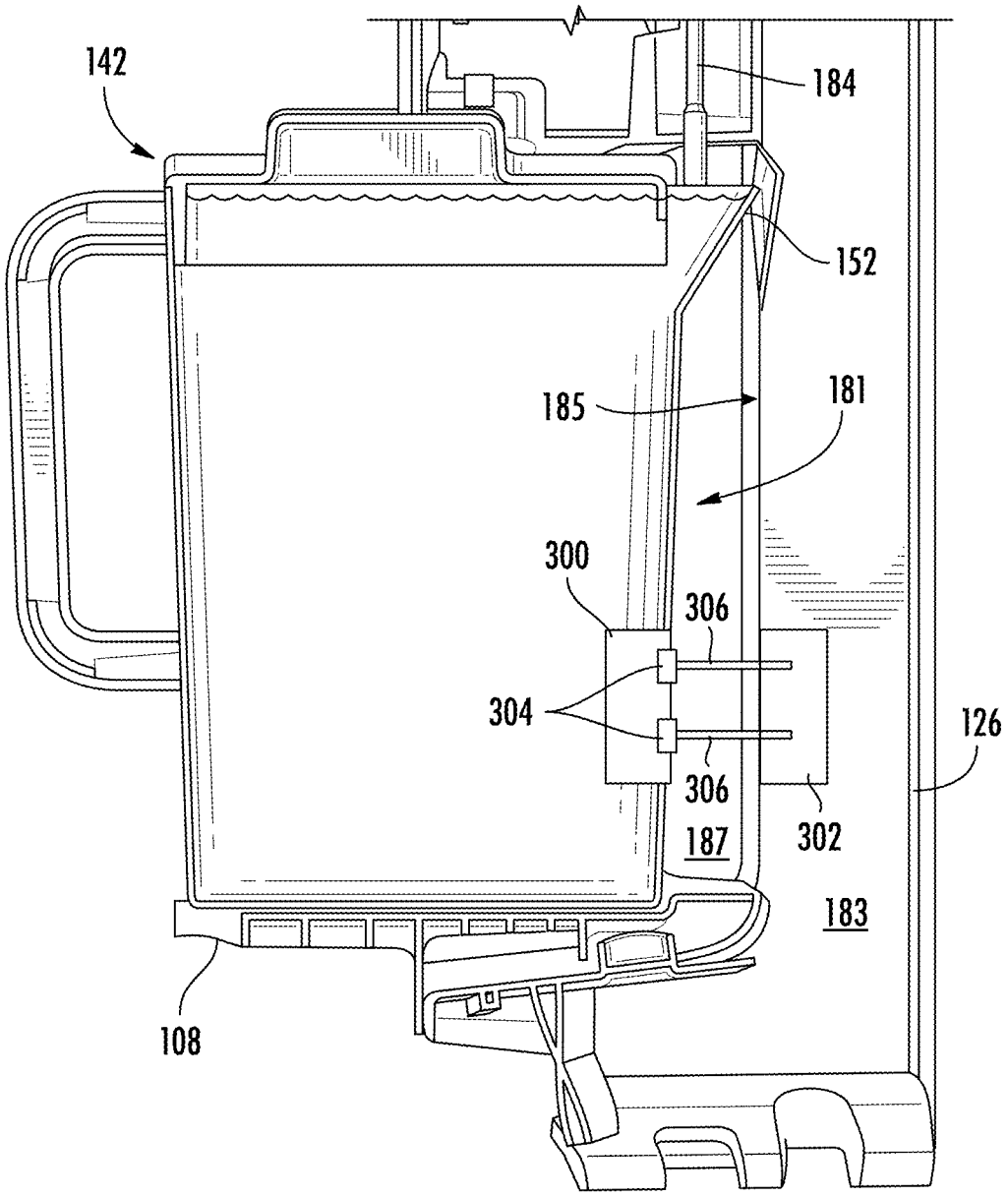
FIG. 6 provides a sectional view of a portion of a door of a refrigerator appliance with a pitcher docked therein in accordance with one or more exemplary embodiments of the present disclosure.

FIG. 3 provides a perspective view of exemplary door 126 of refrigerator appliance 100 according to one or more exemplary embodiments of the present disclosure, and FIG. 4 provides an enlarged view of a lower portion of the exemplary door 126 of FIG. 3. In the illustrated exemplary embodiments, the autofill pitcher system 140 is provided on the left door 126. As noted above, such is by way of example only and the pitcher system 140 may be provided on right door 128 or elsewhere within the fresh food chamber 122 in various embodiments. As may be seen in FIGS. 3 and 4, the pitcher 142 of the autofill pitcher system 140 may be accessible when the door, e.g., left door 126, is in an open position. The pitcher 142 may be supported within a cavity 181 (FIG. 6). In embodiments which include the dispenser, the cavity 181 may be positioned below a portion of the dispenser 180. The cavity 181 may be defined by at least one cavity wall 183, such as a single continuous wall that extends at least partially around one or more sides, such as three sides, of the pitcher 142 when the pitcher 142 is received, e.g., docked, in the cavity 181, and a support shelf 108 at a bottom of the cavity 181.

It will be appreciated that the present subject matter can be used with other types of refrigerator appliances as well, such as e.g., top mount, or top freezer, refrigerator appliances or single door refrigerators. Consequently, the description set forth herein is not intended to limit the present subject matter in any aspect.

Figure 5:
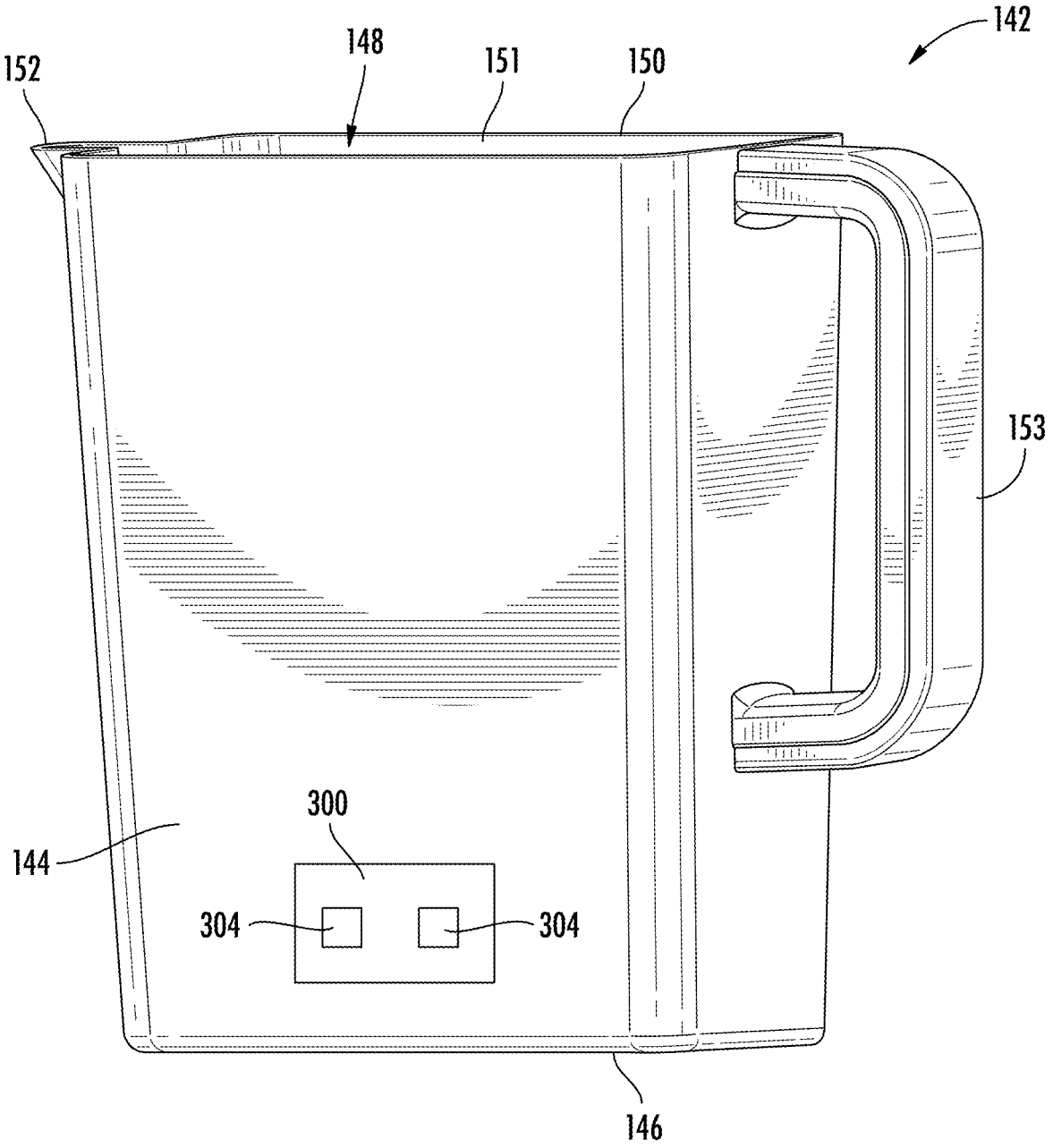
FIG. 5 provides a perspective view of a pitcher in accordance with one or more exemplary embodiments of the present disclosure.

Further details of exemplary pitcher 142 may be seen with reference to FIG. 5. FIG. 5 is a perspective view of a representative pitcher 142 comprising a pitcher wall 144 connected to, or formed with, pitcher bottom wall 146. In the illustrated exemplary embodiment, the pitcher wall 144 is a single continuous side wall which extends completely around the outermost perimeter of the pitcher bottom wall 146 and extends upward from the pitcher bottom wall 146 generally along the vertical direction V. It should be understood that references herein throughout to the orthogonal direction system including vertical direction V, lateral direction L, and transverse direction T in the context of the pitcher 142 are with reference to when the pitcher 142 is docked in the cavity 181 and, in embodiments where the pitcher system 140 is provided on a door of the refrigerator appliance, the door is in the closed position.

A top edge 150 is formed by the pitcher wall 144 at the end of the pitcher opposite the pitcher bottom wall 146. The pitcher wall 144 and pitcher bottom wall 146 define an internal volume of the pitcher 142, i.e., a pitcher volume 148, accessible through opening 151 defined by the top edge 150. In additional embodiments, the pitcher 142 may include a plurality of side walls which collectively extend completely around the outermost perimeter of the pitcher bottom wall 146 and thereby define the internal volume of the pitcher 142, e.g., pitcher volume 148 may be enclosed on four side (such as front, back, left, and right) by one or more side walls and on a fifth side (e.g., bottom) by the pitcher bottom wall 146, and the pitcher volume 148 may be open on the sixth side, e.g., at the top.

For convenience, top edge 150 may also define a spout 152 at a first end (e.g., front end) of the pitcher 142 to facilitate directing liquid into, or out of, the pitcher 142. At a second end of the pitcher, opposite the spout 152, a handle 153 may be included to provide a gripping area to aid in manipulating the pitcher 142. In some embodiments, the pitcher 142 may include a lid 154 (FIG. 4) removably received in, and fitted to, the opening 151 at the top edge 150.

Exemplary pitcher 142 is illustrated as a generally hollow rectangular cuboid for ease of illustration only. Other embodiments may have other shapes, for example a hollow cylinder, or may be non-prismatic, among other possible examples, and may or may not have features such as a spout or a handle.

The pitcher 142 may further include a detachable electrical connector configured to connect between the pitcher 142 and the cavity 181. For example, the detachable electrical connector may be a pogo pin connector, such as one of a pogo pin or a contact pad. In the particular example illustrated in FIG. 5, the detachable electrical connector on the pitcher 142 may include a terminal block 300 with one or more contact pads 304 thereon.

As illustrated for example in FIG. 6, cavity 181 is configured to receive the pitcher 142. In the illustrative embodiment shown in the figures, the cavity 181 is positioned on the inner surface 134 of left door 126 of the refrigerator appliance 100 (as may be seen, e.g., in FIGS. 2 and 3). Other embodiments may have the cavity 181 on other doors or elsewhere in the fresh food chamber 122. As illustrated, the cavity 181 comprises a support or shelf 108 to support the pitcher 142 in the vertical direction V. As illustrated, the shelf 108 is dedicated to support the pitcher 142 on the left door 126. In other embodiments, the shelf 108 may be positioned on any other door or within the cabinet 120. In other embodiments, the shelf 108 may not be a dedicated shelf for the pitcher 142. The shelf 108 may have other or additional uses, for example storage of other food products on the door or in the cabinet 120, e.g., in the fresh food chamber 122 therein. Other features such as a detent or rabbet (not shown) may be provided to secure the pitcher 142 in the cavity 181 during filling and as the door 126 is opened and closed to provide access to the fresh food chamber 122.

As mentioned, the cavity 181 may further include one or more walls which extend around one or more sides of the pitcher 142 when the pitcher 142 is received in the cavity 181. For example, the cavity 181 may include an inner wall or rear wall 183 and one or more side walls 187, e.g., as illustrated in FIG. 6.

In embodiments which include the dispenser 180, the dispenser 180 may include a fill tube 184 adapted to direct water from a water supply (not shown) to the pitcher 142. The water supply may be, for example, a water utility supply or a private source water supply, such as a private well. A valve (not shown) may be provided in line with the fill tube 184 between the water supply and the pitcher 142 to selectively allow the flow of water to the pitcher 142.

As may be seen, e.g., in FIG. 6, the refrigerator appliance 100 may include a detachable electrical connection between the pitcher and the cavity. For example, the detachable connection may include a projecting connector extending from one of the pitcher wall or the cavity wall, such as a projecting connector extending from the cavity wall, e.g., from one of the walls such as the rear wall 183 as illustrated in FIG. 6.

In some embodiments, the detachable electrical connection may be a pogo pin connection. For example, in such embodiments the pogo pin connection may include a pogo pin on one of the pitcher wall or the cavity wall and a contact pad on the other of the pitcher wall or the cavity wall. For example, in the illustrated exemplary embodiment of FIG. 6, the pogo pin connection includes two pogo pins 306 which are spring-loaded (as those of ordinary skill in the art will recognize is inherent in the term pogo pin when used in the context of such electrical connectors) and which project into the cavity 181. When the pitcher 142 is received in the cavity 181, the contact pads 304 on the pitcher 142 contact, e.g., touch and are in electrical communication with, the pogo pins 306, such that the pogo pins 306 may retract partially into the cavity wall 183, e.g., the biasing force of the spring-loaded pogo pins 306 urges each pogo pins 306 into firm contact with one respective contact pad 304. In additional embodiments, the relative positions may be reversed, e.g., the pogo pins 306 may be provided on the pitcher 142 while the contact pads 304 may be provided in the cavity 181, such as on one of the cavity walls.

In some embodiments, the pogo pin connection may further include a first terminal block 300 positioned in or on the pitcher 142 and a second terminal block 302 positioned within the cavity wall, e.g., within the rear wall 183 as illustrated in FIG. 6. For example, the first terminal block 300 may extend through a side wall, e.g., wall 144, of the pitcher 142, and the second terminal block 302 may be positioned in the rear wall 183 of the cavity 181.

The second terminal block 302 may be connected to and in electrical communication with an electrical power supply in the refrigerator appliance 100, such as the second terminal block 302 may be wired into an electrical circuit within the refrigerator appliance 100. The first terminal block 300 may be electrically coupled to one or more electrical components in or on the pitcher 142, e.g., a light or other electrical component. Thus, when the detachable electrical connection is complete, electrical power may be supplied to the one or more electrical components in or on the pitcher 142 from the electrical system in the refrigerator appliance 100 via the detachable electrical connection between the pitcher 142 and the cavity 181.

In embodiments where the pogo pin connection includes the first terminal block 300 and the second terminal block 302, an outer surface (e.g., the surface on which the contact pads 304 are positioned or, in alternative embodiments, the surface from which the pogo pins 306 project) of the first terminal block 300 may be generally flush with an outer surface of the pitcher wall 144. Also in embodiments where the pogo pin connection includes the first terminal block 300 and the second terminal block 302, an outer surface of the second terminal block 302 may be generally flush with an inner surface of the cavity wall, e.g., inner surface 185 of rear wall 183 as in the illustrated exemplary embodiment in FIG. 6.

For example, the pogo pin connection may further include the contact pad 304 on the first terminal block 300, such as two or more contact pads 304 on the first terminal block 300, and the pogo pin 306 in the second terminal block 302, such as two or more pogo pins 306 on the second terminal block 302. It should be understood that the pogo pin connection includes equal numbers of contact pads as pogo pins in a one-to-one correspondence.

In some embodiments, the cavity 181 may include only the shelf 108, e.g., without any side walls or rear wall. For example, the shelf 108 may be provided in the cabinet 120 rather than on a door, such as one of the (unlabeled) shelves in the fresh food chamber 122 illustrated in FIG. 2. In such embodiments, the detachable electrical connection may be provided on pitcher bottom wall 146 and shelf 108. Thus, the shelf 108 may also be considered a wall of the cavity 181, e.g., a bottom wall of the cavity 181, such that where the cavity 181 may include at least one wall, the one wall may be a bottom wall, e.g., shelf 108. Similarly, where the detachable electrical connection may include a projecting connector extending from the cavity wall, the cavity wall may be a bottom wall, e.g., shelf 108, and where the detachable electrical connection may include a pogo pin connection, the pogo pin(s) or contact pads(s) of the pogo pin connection may be positioned on the shelf 108 or other bottom wall of the cavity 181.

The detachable electrical connection between the pitcher and the cavity may be used to provide electrical power to any one or more electrical components in or on the pitcher 142. For example, the pitcher 142 may include an ultrasonic module within the internal volume 148, a light in the lid 154, and/or other similar electronic components.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A refrigerator appliance comprising:

a cabinet defining a fresh food chamber;

a pitcher comprising at least one pitcher wall and an internal volume defined within the at least one pitcher wall;

a cavity in the fresh food chamber, the cavity defined by at least one cavity wall, the cavity configured to receive the pitcher; and a detachable electrical connection between the pitcher and the cavity, the detachable electrical connection comprising a pogo pin connection, the pogo pin connection comprising a pogo pin extending from the pitcher wall and a contact pad on the cavity wall, wherein the pogo pin connection further comprises a first terminal block positioned in or on the pitcher and a second terminal block positioned within the cavity wall, wherein the contact pad of the pogo pin connection is positioned on an outer surface of the second terminal block, wherein the outer surface of the second terminal block is generally flush with an inner surface of the cavity wall.

2. The refrigerator appliance of claim 1, wherein the first terminal block extends through a side wall of the pitcher and wherein the cavity wall within which the second terminal block is positioned is a rear wall of the cavity.

3. The refrigerator appliance of claim 1, wherein the pogo pin is a first pogo pin and the contact pad is a first contact pad, and wherein the pogo pin connection further comprises a second pogo pin and a second contact pad.

4. The refrigerator appliance of claim 1, wherein the inner surface of the cavity wall is an exposed surface.

5. The refrigerator appliance of claim 4, wherein the contact pad is open to the cavity.

6. A pitcher for a refrigerator appliance, the refrigerator appliance comprising a cabinet defining a fresh food chamber, the pitcher comprising:

at least one pitcher wall and an internal volume defined within the at least one pitcher wall, the pitcher configured to be received in a cavity defined in the fresh food chamber; and a detachable electrical connector configured to connect between the pitcher and the cavity, the detachable electrical connector comprising a pogo pin connector, the pogo pin connector comprising a contact pad on the pitcher wall, the contact pad configured to engage with a pogo pin, wherein the detachable electrical connector further comprises a terminal block, wherein the contact pad is positioned on an outer surface of the terminal block, wherein the outer surface of the terminal block is generally flush with an outer surface of the pitcher wall.

7. The pitcher of claim 6, wherein the terminal block extends through a side wall of the pitcher.

8. The pitcher of claim 6, wherein the contact pad is a first contact pad, and wherein the detachable electrical connector further comprises a second contact pad.

9. The pitcher of claim 6, wherein the outer surface of the pitcher wall is an exposed surface.

10. The pitcher of claim 9, wherein the contact pad is open to an external environment around the pitcher.

11. A refrigerator appliance comprising:

a cabinet defining a fresh food chamber;

a pitcher comprising at least one pitcher wall and an internal volume defined within the at least one pitcher wall;

a cavity in the fresh food chamber, the cavity defined by at least one cavity wall, the cavity configured to receive the pitcher; and a detachable electrical connection between the pitcher and the cavity, the detachable electrical connection comprising a pogo pin connection, the pogo pin connection comprising a contact pad pin on the pitcher wall and a pogo pin extending from the cavity wall, wherein the pogo pin connection further comprises a first terminal block positioned in or on the pitcher and a second terminal block positioned within the cavity wall, wherein the contact pad of the pogo pin connection is positioned on an outer surface of the first terminal block, wherein the outer surface of the first terminal block is generally flush with an outer surface of the pitcher wall.

12. The refrigerator appliance of claim 11, wherein the first terminal block extends through a side wall of the pitcher and the second terminal block is positioned in a rear wall of the cavity.

13. The refrigerator appliance of claim 11, wherein the pogo pin is a first pogo pin and the contact pad is a first contact pad, and wherein the pogo pin connection further comprises a second pogo pin and a second contact pad.

14. The refrigerator appliance of claim 11, wherein the outer surface of the pitcher wall is an exposed surface.

15. The refrigerator appliance of claim 14, wherein the contact pad is open to the cavity when the pitcher is received in the cavity.

* * * * *